US008411013B2

(12) United States Patent
Tanaka et al.

(10) Patent No.: US 8,411,013 B2
(45) Date of Patent: Apr. 2, 2013

(54) ACTIVE MATRIX LIQUID CRYSTAL DISPLAY DEVICE AND DRIVING METHOD WITH OVERLAPPING WRITE PERIODS

(75) Inventors: Yukio Tanaka, Kanazawa (JP); Kenji Nakao, Kanazawa (JP); Tetsuo Fukami, Ishikawa-gun (JP); Kazuhiro Nishiyama, Kanazawa (JP)

(73) Assignee: Japan Display Central Inc., Fukaya-shi (JP)

( * ) Notice: Subject to any disclaimer, the term of this patent is extended or adjusted under 35 U.S.C. 154(b) by 782 days.

(21) Appl. No.: 12/166,790

(22) Filed: Jul. 2, 2008

(65) Prior Publication Data

US 2009/0009463 A1 Jan. 8, 2009

(30) Foreign Application Priority Data

Jul. 6, 2007 (JP) ..... 2007-178966

(51) Int. Cl.
*G09G 3/36* (2006.01)

(52) U.S. Cl. ..... 345/99

(58) Field of Classification Search ..... 345/99
See application file for complete search history.

(56) References Cited

U.S. PATENT DOCUMENTS

| | | | | |
|---|---|---|---|---|
| 6,753,835 | B1 * | 6/2004 | Sakai | 345/87 |
| 2003/0080932 | A1 * | 5/2003 | Konno et al. | 345/96 |
| 2003/0169247 | A1 * | 9/2003 | Kawabe et al. | 345/204 |
| 2004/0183792 | A1 * | 9/2004 | Takada et al. | 345/204 |
| 2005/0157559 | A1 * | 7/2005 | Lee et al. | 365/185.22 |
| 2005/0270873 | A1 * | 12/2005 | Lee et al. | 365/205 |
| 2006/0055661 | A1 * | 3/2006 | Kawaguchi | 345/102 |
| 2007/0103425 | A1 * | 5/2007 | Tanaka et al. | 345/102 |
| 2007/0139341 | A1 * | 6/2007 | Kubo et al. | 345/98 |
| 2007/0211009 | A1 * | 9/2007 | Teranishi | 345/98 |
| 2007/0229447 | A1 * | 10/2007 | Takahara et al. | 345/102 |

FOREIGN PATENT DOCUMENTS

| | | | |
|---|---|---|---|
| JP | 2002-040390 | A | 2/2002 |
| JP | 2004-233949 | A | 8/2004 |
| JP | 2004-264480 | A | 9/2004 |
| JP | 2005-114941 | A | 4/2005 |
| JP | 2007-140066 | | 6/2007 |
| JP | 2007-163704 | A | 6/2007 |
| WO | WO 2007/026551 | A1 | 3/2007 |

OTHER PUBLICATIONS

U.S. Appl. No. 12/183,393, filed Jul. 31, 2008, Tanaka, et al.

(Continued)

*Primary Examiner* — Chanh Nguyen
*Assistant Examiner* — Robert Stone
(74) *Attorney, Agent, or Firm* — Oblon, Spivak, McClelland, Maier & Neustadt, L.L.P.

(57) ABSTRACT

A display device includes a circuit which is configured to execute such control that write of a non-video signal in pixels is executed in the first period, write of a video signal in the pixels is executed in the second period which partly overlaps the first period, write of the video signal, in the pixels is executed in the third period which partly overlaps the second period, the write of the non-video signal and the write of the video signal are alternately executed in units of one horizontal cycle or horizontal cycles in a period in which the first period overlaps the second period, and the write of the video signal corresponding to the second period and the third period are alternately executed in units of one horizontal cycle or horizontal cycles in a period in which the second period overlaps the third period.

5 Claims, 8 Drawing Sheets

OTHER PUBLICATIONS

U.S. Appl. No. 12/877,551, filed Sep. 8, 2010, Tanaka, et al.
U.S. Appl. No. 13/220,932, filed Aug. 30, 2011, Tanaka, et al.
Japanese Office Action Issued May 15, 2012 in Patent Application No. 2007-178966 (with English translation).

* cited by examiner

ACTIVE MATRIX LIQUID CRYSTAL DISPLAY DEVICE AND DRIVING METHOD WITH OVERLAPPING WRITE PERIODS

CROSS-REFERENCE TO RELATED APPLICATIONS

This application is based upon and claims the benefit of priority from prior Japanese Patent Application No. 2007-178966, filed Jul. 6, 2007, the entire contents of which are incorporated herein by reference.

BACKGROUND OF THE INVENTION

1. Field of the Invention

The present invention relates generally to a liquid crystal display device and a driving method of the liquid crystal display device, and more particularly to an active matrix liquid crystal display device and a driving method of the active matrix liquid crystal display device.

2. Description of the Related Art

In recent years, with an increase in the range of purposes of use of liquid crystal panels, the liquid crystal displays have begun to be widely applied to vehicles with rapid prevalence (e.g. displays for navigation, and displays for rear-seat entertainment). For example, in a case where a liquid crystal panel is applied to the use in vehicles, it is required that video display be normally performed in a wide temperature range, in particular, even at very low temperatures of −30° C. to 0° C. Attention has been paid to an OCB (Optically Compensated Bend) liquid crystal mode with high responsivity characteristics, as a liquid crystal mode that is suited to operations at such very low temperatures.

In general, there is a tendency that at low temperatures the viscosity of a liquid crystal material increases and the response speed decreases. However, the OCB liquid crystal has sufficiently high responsivity characteristics for display at low temperatures, and is expected as a liquid crystal material for vehicle use.

There has been proposed a liquid crystal display device in which black display is executed at a predetermined time ratio in one frame period in order to prevent a so-called "reverse transition" phenomenon in which the liquid crystal alignment state in the OCB mode transitions reversely from a bend state to a splay state (Jpn. Pat. Appln. KOKAI Publication No. 2007-140066). In this case, at least one black signal write scan (black insertion scan) and at least one signal write scan (signal scan) are executed in one frame period.

The concept of timing setting in this method is as follows. To begin with, a basic horizontal cycle is determined, which is enough to write a non-video signal for black insertion or a video signal in one liquid crystal pixel. Thereby, a time is calculated, which is necessary for scanning a screen from its upper part to its lower part (or from its lower part to its upper part) in a black insertion write period or a video signal write period.

Next, the relative temporal relationship between the black insertion scan and the first signal write scan is determined in the following manner. If the timing of the start of black insertion scan is fixed at the beginning of the frame period, the relative temporal relationship can be varied by varying the timing of the start of signal write scan.

As the time from the start of black insertion scan (i.e. the beginning of one frame period) to the start of signal write scan is made shorter, a longer hold period (i.e. a period from the end of the first signal scan to the start of black insertion in the next frame period; the liquid crystal is kept in the signal display state) can be secured, and high luminance can be obtained. However, if this time is too short, reverse transition occurs in the OCB liquid crystal.

Taking the above into account, the time from the start of black insertion scan to the start of signal write scan is set to be as short as possible within the range in which no reverse transition occurs. In general, reverse transition tends to easily occur at high temperatures and to hardly occur at low temperatures. Thus, in accordance with temperatures, the time from the start of black insertion scan to the start of signal write scan is set to be long at high temperatures and is set to be short at low temperatures.

By driving the liquid crystal display device in the above-described manner, it is possible to perform video display which is excellent in moving image visibility in a wide temperature range including very low temperatures of −30° C. to 0° C., and is also excellent in power efficiency, luminance and contrast.

When the liquid crystal display device is driven as described above, however, vertical crosstalk appears in a displayed image in some cases.

BRIEF SUMMARY OF THE INVENTION

The present invention has been made in consideration of the above-described problems, and the object of the invention is to provide a liquid crystal display device which prevents the occurrence of the above-described crosstalk and has good display quality, and a driving method of the liquid crystal display device.

According to a first aspect of the present invention, there is provided a liquid crystal display device comprising: a plurality of liquid crystal pixels which are arrayed substantially in a matrix; a driver circuit which cyclically writes a non-video signal and a video signal to each of the plurality of liquid crystal pixels as pixel voltages; and a control circuit which controls an operation timing of the driver circuit, wherein the control circuit sets, in one frame period, a first period which is shorter than the one frame period, a second period which partly overlaps the first period and is shorter than the one frame period, and a third period which partly overlaps the second period and is shorter than the one frame period, and the control circuit is configured to execute control of the driver circuit such that write of the non-video signal in the plurality of liquid crystal pixels is executed in the first period, write of the video signal in the plurality of liquid crystal pixels is executed in the second period, write of the same video signal as the video signal, which is written in the second period, in the plurality of liquid crystal pixels is executed in the third period, the write of the non-video signal and the write of the video signal are alternately executed in units of one horizontal cycle or a plurality of horizontal cycles in a period in which the first period overlaps the second period, and the write of the video signal corresponding to the second period and the write of the video signal corresponding to the third period are alternately executed in units of one horizontal cycle or a plurality of horizontal cycles in a period in which the second period overlaps the third period.

According to a second aspect of the present invention, there is provided a driving method of a liquid crystal display device, comprising: setting, in one frame period, a first period which is shorter than the one frame period, a second period which partly overlaps the first period and is shorter than the one frame period, and a third period which partly overlaps the second period and is shorter than the one frame period; executing write of a non-video signal in a plurality of liquid crystal pixels in the first period; executing write of a video signal in the plurality of liquid crystal pixels in the second period; executing write of the same video signal as the video signal, which is written in the second period, in the plurality of liquid crystal pixels in the third period; alternately executing the write of the non-video signal and the write of the video signal in units of one horizontal cycle or a plurality of horizontal cycles in a period in which the first period overlaps the second period; and alternately executing the write of the video signal corresponding to the second period and the write of the video signal corresponding to the third period in units of one horizontal cycle or a plurality of horizontal cycles in a period in which the second period overlaps the third period.

The present invention can provide a liquid crystal display device which prevents the occurrence of crosstalk and has good display quality, and a driving method of the liquid crystal display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
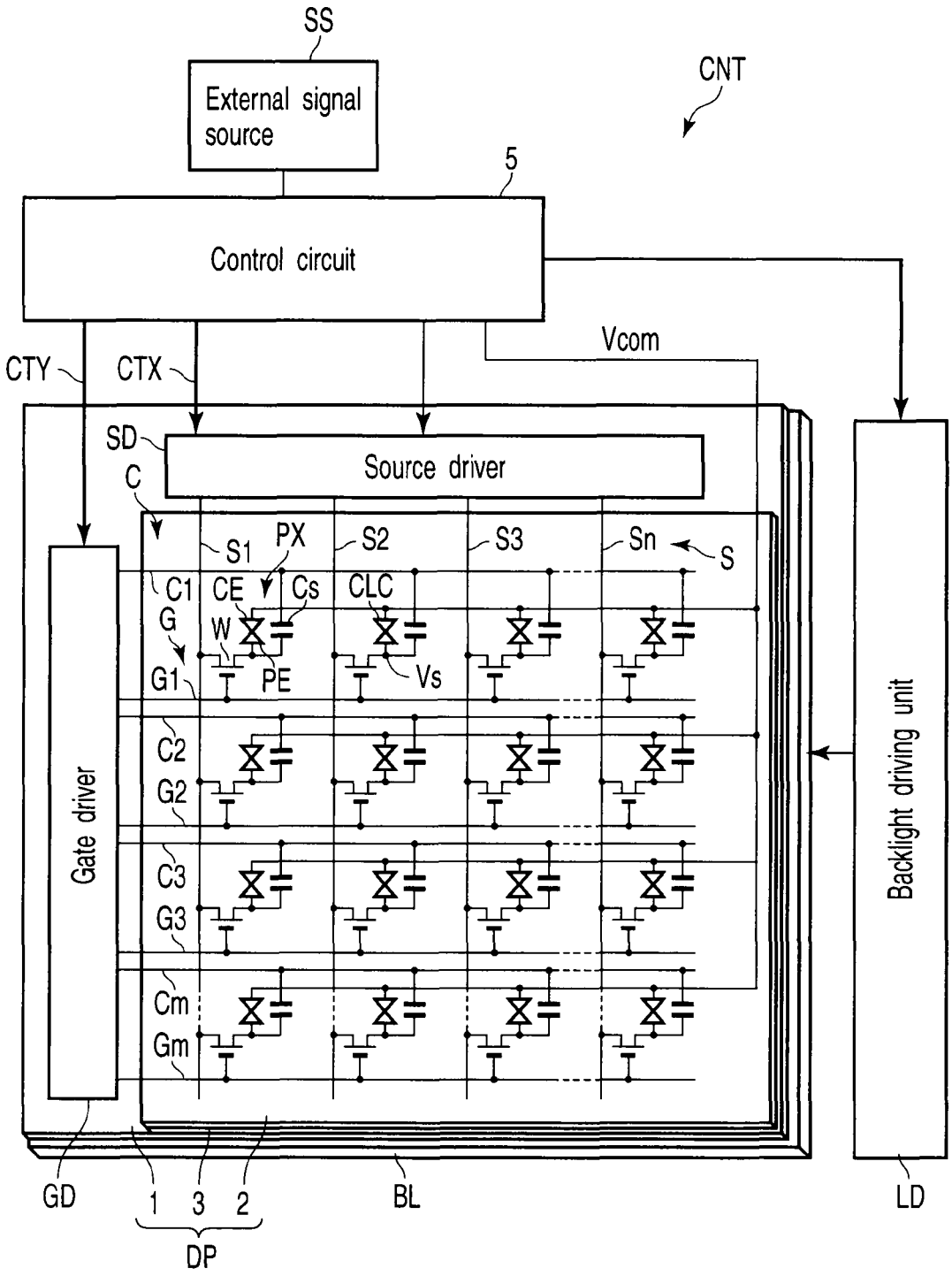
FIG. 1 schematically shows an example of the structure of a liquid crystal display device according to a first embodiment of the present invention.

A liquid crystal display device according to an embodiment of the present invention will now be described with reference to the accompanying drawings. As shown in FIG. 1, the liquid crystal display device according to the embodiment includes an OCB mode liquid crystal display panel DP, a backlight BL which illuminates the liquid crystal display panel DP, and a controller CNT which controls the liquid crystal display panel DP and backlight BL.

The liquid crystal display panel DP includes a pair of electrode substrates, namely, an array substrate 1 and a counter-substrate 2, and a liquid crystal layer 3 which is held between the array substrate 1 and counter-substrate 2. The liquid crystal layer 3 includes, as a liquid crystal material, an OCB mode liquid crystal which is transitioned in advance, for example, from splay alignment to bend alignment in order to execute a normally-white display operation. In this embodiment, reverse transition of the liquid crystal from the bend alignment to splay alignment is prevented by cyclically applying a driving voltage corresponding to black display to the liquid crystal layer 3.

In addition, the liquid crystal display panel DP includes a display section which is composed of display pixels PX that are arrayed substantially in a matrix. The array substrate 1 includes a transparent insulating substrate which is formed of, e.g. glass. A plurality of pixel electrodes PE are disposed in association with the respective display pixels PX on the transparent insulating substrate.

The counter-substrate 2 includes a color filter (not shown) which is formed of red, green and blue color layers disposed on a transparent insulating substrate of, e.g. glass, and a counter-electrode CE which is disposed on the color filter and is opposed to the plural pixel electrodes PE.

The pixel electrodes PE and counter-electrode CE are formed of a transparent electrode material such as ITO and are covered with alignment films (not shown), respectively, which are subjected to rubbing treatment in mutually parallel directions. Each pixel electrode PE and counter-electrode CE, together with a pixel region which is a part of the liquid crystal layer 3 that is controlled to have a liquid crystal molecular alignment corresponding to an electric field from the pixel electrode PE and counter-electrode CE, constitute the display pixel PX.

Each of the display pixels PX has a liquid crystal capacitance Clc between the associated pixel electrode PE and counter-electrode CE. The liquid crystal capacitance Clc is determined by a specific dielectric constant of liquid crystal material, a pixel electrode area, and a liquid crystal cell gap. In addition, a storage capacitance Cs is constituted by a voltage that is applied to the pixel electrode PE and a voltage that is applied to a storage capacitance line C which is disposed in a manner to extend substantially in parallel to a scanning line G.

Further, the array substrate 1 includes a plurality of scanning lines G (G1 to Gm) which are disposed along rows of the pixel electrodes PE, a plurality of signal lines S (S1 to Sn) which are disposed along columns of the pixel electrodes PE, and a plurality of pixel switches W which are disposed near intersections between the scanning lines G and signal lines S.

Each pixel switch W permits, when driven via the associated scanning lines G, electrical conduction between the associated signal lines S and the associated pixel electrodes PE. Each of the pixel switches W is composed of, e.g. a thin-film transistor. The gate of the pixel switch W is connected to the scanning line G, and the source-drain path of the pixel switch W is connected between the signal line S and the pixel electrode PE.

The controller CNT includes a gate driver GD which successively drives the scanning lines G1 to Gm so as to turn on the plural pixel switches W on a row-by-row basis; a source driver SD which outputs video signals or non-video signals to the plural signal lines S1 to Sn during a time period in which the pixel switches W of each row are turned on by the driving of the associated scanning line G; a backlight driving unit LD which drives the backlight BL; and a control circuit 5 which controls the gate driver GD, source driver SD and backlight driving unit (inverter) LD.

The control circuit 5 is configured to execute an initializing process for transitioning liquid crystal molecules from splay alignment to bend alignment by varying a counter-voltage Vcom at a time of power-on and applying a relatively high driving voltage to the liquid crystal layer 3.

The control circuit 5 outputs to the gate driver GD a control signal CTG which is generated on the basis of a sync signal that is input from an external signal source SS. The control circuit 5 outputs to the source driver SD a control signal CTS which is generated on the basis of the sync signal that is input from the external signal source SS, and a video signal or a reverse-transition prevention voltage for black insertion, which is input from the external signal source SS. Further, the control circuit 5 outputs a counter-voltage Vcom, which is to be applied to the counter-electrode CE, to the counter-electrode CE of the counter-substrate 2.

Specifically, the source driver SD applies source voltages to the plural signal lines in parallel. The source voltage is applied to the pixel electrode PE of the liquid crystal pixel PX of the selected row via the associated pixel switch X. The liquid crystal capacitance Clc is constituted between the counter-electrode CE and the pixel electrode PE by the source voltage that is applied to the pixel electrode PE and the counter-voltage Vcom that is applied to the counter-electrode CE. In the case of column-reversal driving, the source voltages to all liquid crystal pixels PX are set at opposite polarities between neighboring columns of liquid crystal pixels PX. In the case of frame-reversal driving, the source voltages to all liquid crystal pixels PX are set at opposite polarities between neighboring frames.

Figure 2:
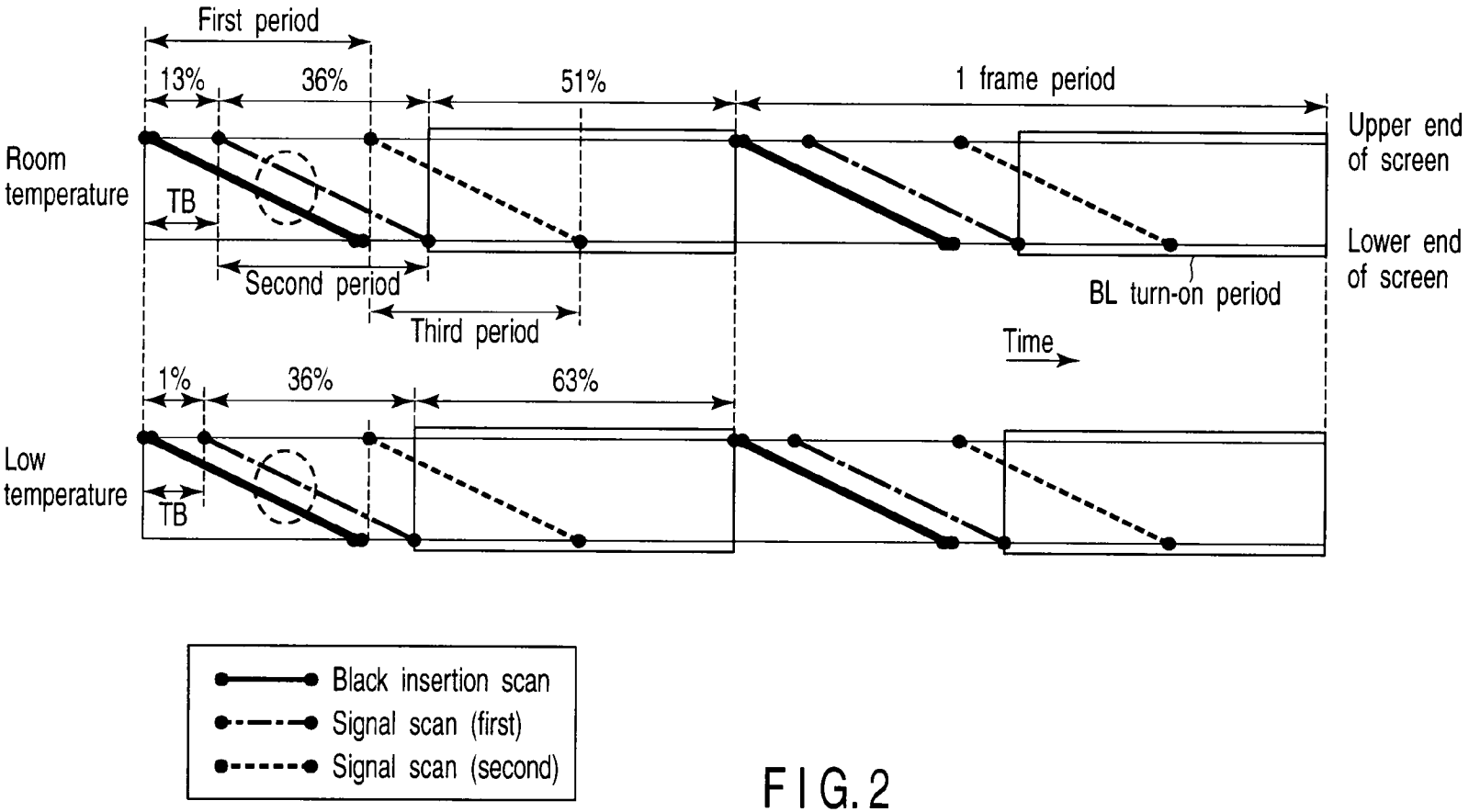
FIG. 2 is a view for explaining an example of a driving method of the liquid crystal display device shown in FIG. 1.

In the liquid crystal display device according to the present embodiment, as shown in FIG. 2, the control circuit 5 sets, in one frame period, a first period which is shorter than the one frame period, a second period which partly overlaps the first period and is shorter than the one frame period, and a third period which partly overlaps the second period and is shorter than the one frame period. FIG. 2 shows the gate scan timing in the panel, with the horizontal axis indicating time, and the vertical axis indicating a vertical position on the screen.

The control circuit 5 controls the gate driver GD and the source driver SD and executes, in the first period, write of non-video signals in the plural liquid crystal pixels. The control circuit 5 controls the gate driver GD and the source driver SD and executes, in the second period, write of video signals in the plural liquid crystal pixels PX, and executes, in the third period, write of the same video signals in the plural liquid crystal pixels as the video signals written in the second period.

Accordingly, under the control of the control signal CTG, the gate driver GD successively drives the plural scanning lines G1 to Gm so as to successively select a row of plural liquid crystal pixels PX for non-video signal write in the first period. In the second period and third period, the gate driver GD, as shown in FIG. 3, successively drives the plural scanning lines G1 to Gm so as to successively select the corresponding row of plural liquid crystal pixels PX for video signal write.

In the first period, while each scanning line, G1 to Gm, is being driven, the source driver SD outputs signal line voltages (source voltages), which are black display voltages Vb(+), Vb(−), as non-video signals for one row. In the second and third periods, while each scanning line, G1 to Gm, is being driven, the source driver SD outputs video signals Vs for the corresponding row as signal line input voltages (source voltages). The voltages Vb(+), Vb(−) are source voltages at the time of application of reverse transition prevention voltage in a case where each pixel potential is positive/negative, relative to the counter-voltage Vcom.

Figure 3:
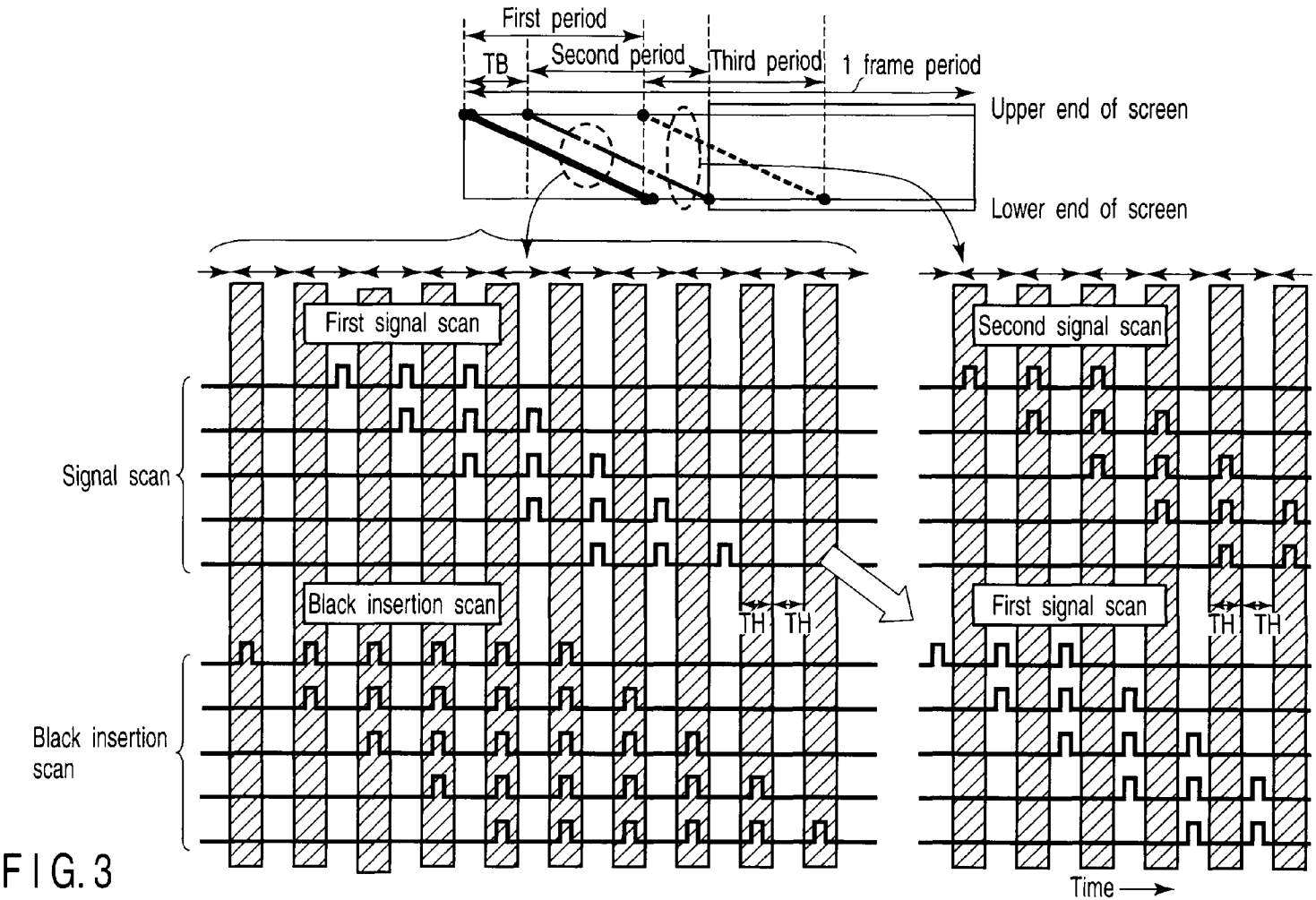
FIG. 3 is a view for explaining the example of the driving method of the liquid crystal display device shown in FIG. 1.

As shown in FIG. 2 and FIG. 3, there is a temporally overlapping part between the black insertion scan, which is executed in the first period, and the first signal scan, which is executed in the second period. In the period of this overlapping part (hereinafter referred to as "first overlap period"), as shown in FIG. 3, black insertion scan and signal write scan are alternately executed in units of 1 horizontal cycle.

Similarly, in the period of overlap (hereinafter referred to as "second overlap period") between the first signal scan, which is executed in the second period, and the second signal scan, which is executed in the third period, the first signal write and the second signal write are alternately executed in units of 1 horizontal cycle.

Specifically, in the overlapping period ("first overlap period") between the first period and the second period, the control circuit 5, as shown in FIG. 3, alternately executes non-video signal write and video signal write in units of one horizontal cycle or a plurality of horizontal cycles. In the second overlap period, the control circuit 5 alternately executes video signal write corresponding to the second period and video signal write corresponding to the third period in units of one horizontal cycle or a plurality of horizontal cycles.

The concept of setting the timing between the black insertion scan and the signal scan in this case is as follows. To begin with, a basic horizontal cycle is determined, which is enough to write a non-video signal for black insertion or a video signal in one liquid crystal pixel. For example, a period TH shown in FIG. 3 is determined. It is not necessary to make equal the length of the period TH for black insertion write and the length of the period TH for video signal write. However, for the purpose of simple description, it is assumed that the length of the period TH is equal between the black insertion write and the video signal write.

The time, which is necessary for scanning a screen from its upper part to its lower part (or from the lower part to the upper part) in the black insertion write or the video signal write is calculated by 2×TH×the number of scanning lines. FIG. 2 shows, by way of example, the case in which the scan time, which is thus calculated, is 36%, which is les than 50% of one frame.

Next, the relative temporal relationship between the black insertion scan and the first signal write scan is determined in the following manner. If the timing of the start of black insertion scan is fixed at the beginning of the frame period, as shown in FIG. 2, the relative temporal relationship can be varied by varying the timing of the start of signal write scan.

As the time (i.e. a period TB in FIG. 2) from the start of black insertion scan (i.e. the beginning of one frame period) to the start of signal write scan is made shorter, a longer hold period (i.e. a period from the end of the first signal scan to the start of black insertion in the next frame period; the liquid crystal is kept in the signal display state) can be secured, and high luminance can be obtained. However, if the period TB is too short, reverse transition occurs in the OCB liquid crystal.

Taking the above into account, the period TB is set to be as short as possible within the range in which no reverse transition occurs. In general, reverse transition tends to easily occur at high temperatures and to hardly occur at low temperatures. Thus, in accordance with temperatures, the period TB is set to be long at high temperatures and is set to be short at low temperatures. FIG. 2 shows, by way of example, the case in which the period TB is set, as a condition of non-occurrence of reverse transition, at 13% of one frame in a room-temperature environment (e.g. 20° C.) or at 1% of one frame in a low-temperature environment (e.g. −20° C.).

In the driving method shown in FIG. 2, the backlight BL is also flickered in sync with the scanning on the panel. The first object of the flickering of the backlight BL is to improve the moving image visibility by flicking the backlight only in a predetermined time period in one frame and thereby performing impulse display as in the case of a CRT.

The second object of flickering the backlight BL is to improve the power efficiency of the backlight and contrast by turning off the backlight BL when the liquid crystal is in the black insertion state and turning on the backlight BL only when the liquid crystal is in the signal write state.

A specific timing of flickering the backlight is as follows. The start of turning on the backlight BL is set at the timing of the completion of the first signal write scan, and the end of turning on the backlight BL is set at the timing of the beginning of black insertion in the next frame. Needless to say, the timing of the end of turn-on of the backlight does not need to strictly coincide with the timing of the start of black insertion, and may be set to slightly disagree in consideration of a turn-on time delay of the liquid crystal.

Specifically, the period of turn-on of the backlight is substantially coincident with the hold period. The timing of the start of turn-on is controlled in accordance with temperatures. In the present embodiment, the backlight turn-on period is 100%−(36%+13%)=51% in a room-temperature environment, and is 100%−(36%+1%)=63% in a low-temperature environment.

In the case shown in FIG. 2, the second auxiliary signal write scan (the same video signal write as the first signal write) is executed during the turn-on period of the backlight. Thus, even in the case where the time of the signal write in the pixel is insufficient with the first signal scan, the signal write in the pixel can surely be executed by the second signal write, and the adverse effect (e.g. decrease in luminance) due to the deficient signal write can be prevented.

In the case shown in FIG. 2, the black insertion scan, which is executed in the first period, is overlapped with the first signal write scan which is executed in the second period. Thereby, the time ratio (=TB/1 frame cycle) for execution of black display in one frame can freely be set and, in particular, can be decreased to the lower limit value that is specified by the prevention of reverse transition. Therefore, a maximum turn-on period of the backlight can be secured.

Furthermore, in the OCB liquid crystal display device, if effective use is made of the fact that reverse transition hardly occurs in the low-temperature environment, the backlight turn-on time can be made longer in the low-temperature environment.

In general, as the temperature lowers, the luminance of the backlight BL decreases and the response speed of the liquid crystal decreases, and, as a result, the luminance of the display pixel decreases. However, if the driving method as shown in FIG. 2 is adopted, the decrease in luminance in the low-temperature environment can be compensated, and a sufficiently bright image can be obtained even in the low-temperature environment.

Figure 4:
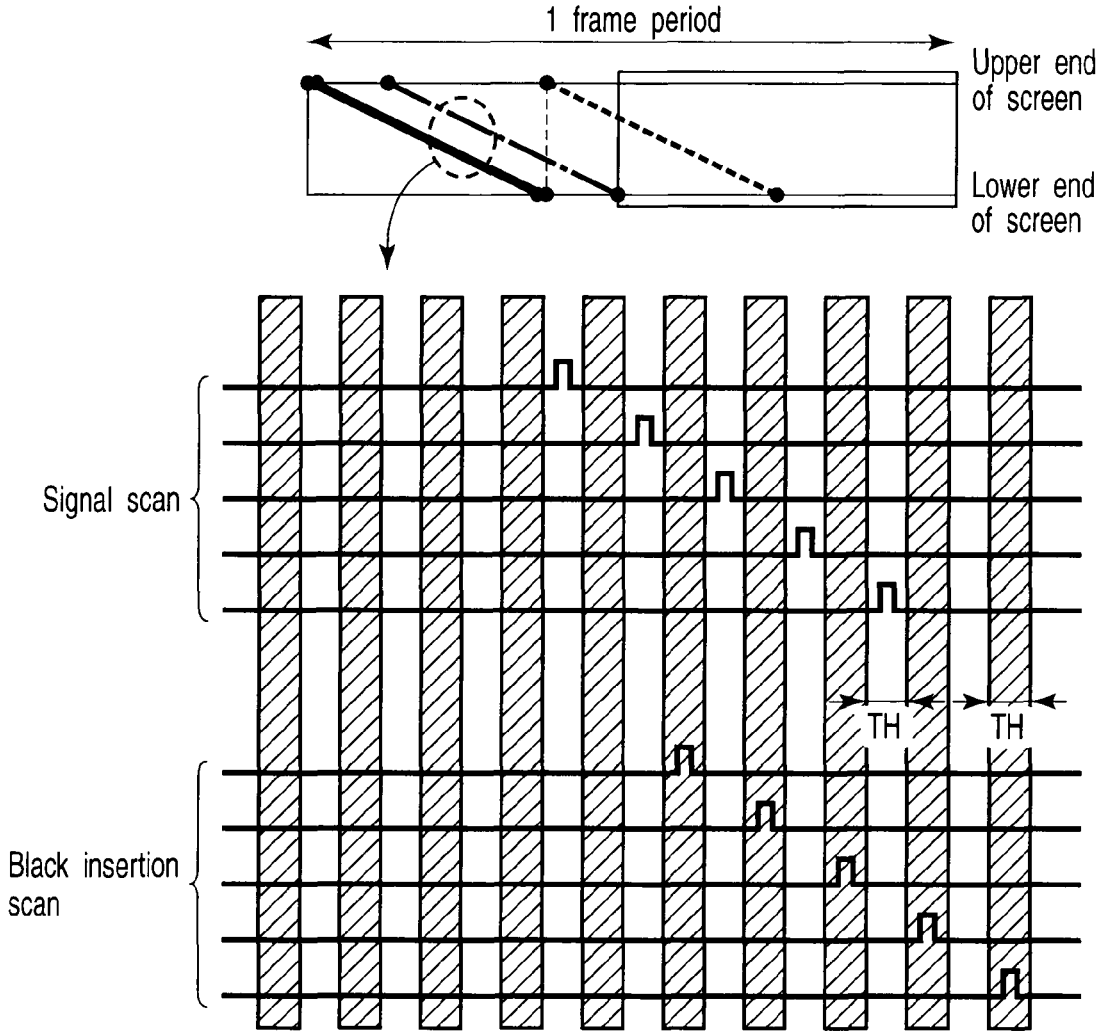
FIG. 4 is a view for explaining another example of the driving method of the liquid crystal display device shown in FIG. 1.

In the meantime, in FIG. 2, in each of the black insertion scan and the signal write scan, each gate line is driven more than once per one scan. Alternatively, as shown in FIG. 4, each gate line G can be driven only once. In the case shown in FIG. 2, each gate line G is driven three times in each of the black insertion scan and the signal write scan. By driving the gate line G more than once, as shown in FIG. 2, the write characteristics can be improved and the decrease in luminance due to deficient write can advantageously be prevented.

By executing the driving as described above, it becomes possible to perform video display which is excellent in moving image visibility in a wide temperature range including very low temperatures of −30° C. to 0° C., and is also excellent in power efficiency, luminance and contrast.

Figure 5:
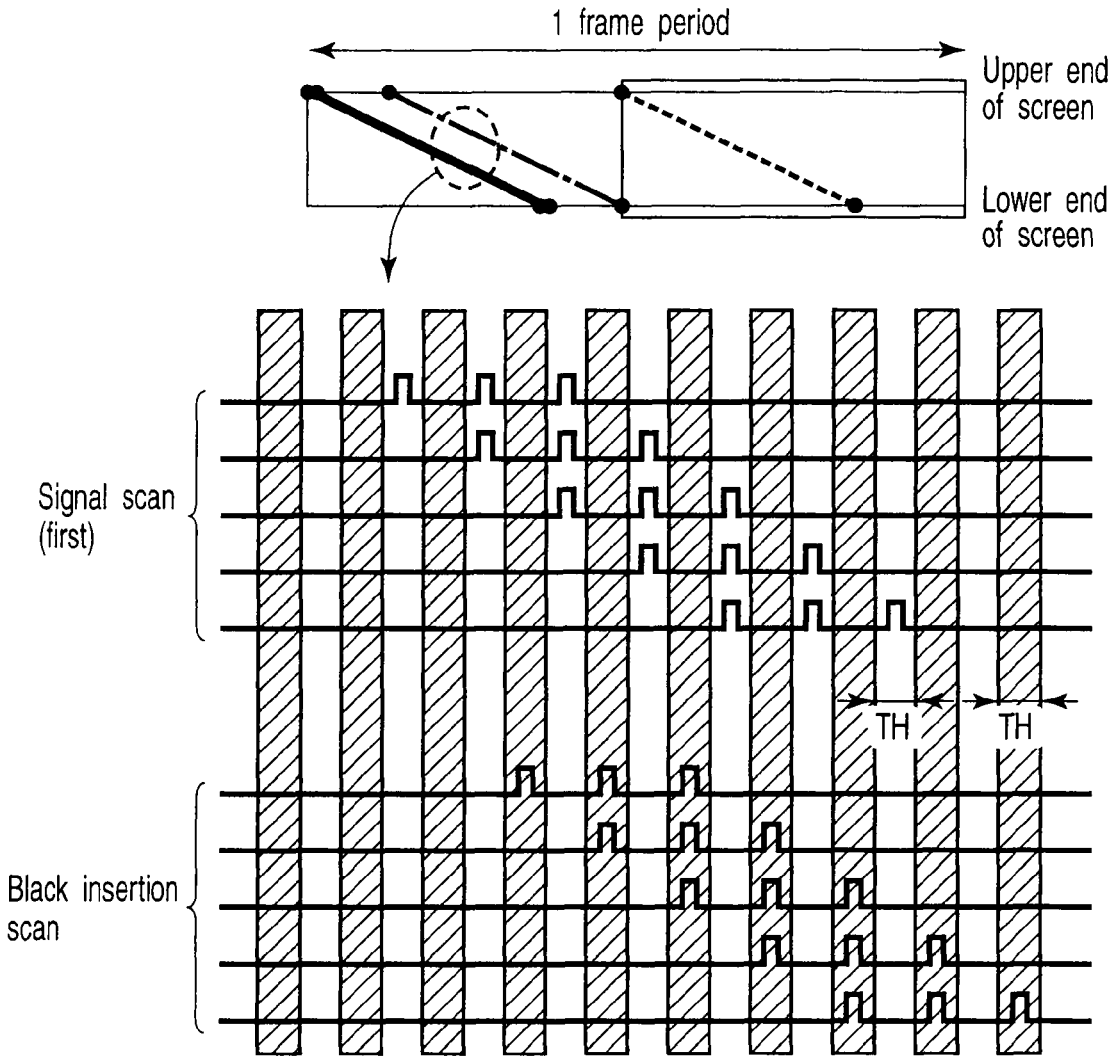
FIG. 5 PRIOR ART
FIG. 5 is a view for explaining a conventional driving method of a liquid crystal display device.

A description is given of the case in which the liquid crystal display device is driven, for example, as shown in FIG. 5, so that the second signal write is started after the end of the first signal write. Specifically, in the case shown in FIG. 5, the control circuit 5 sets the first period, second period and third period in such a manner that there is no overlapping period between the second period and the third period.

Figure 6:
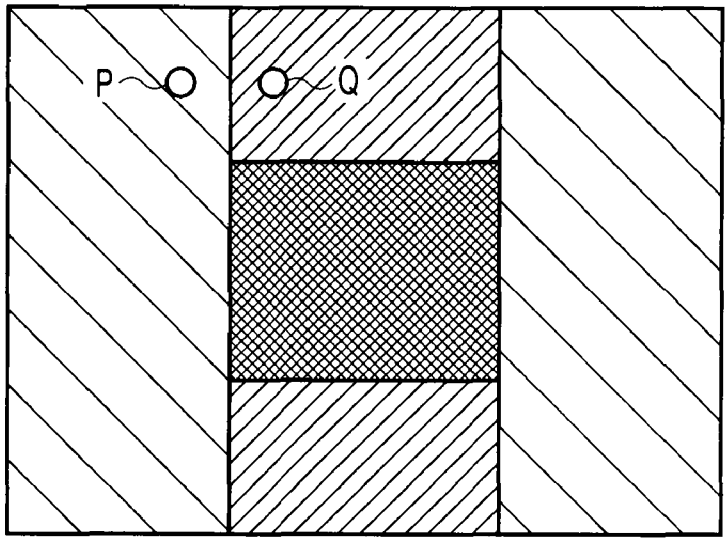
FIG. 6 is a view for describing an example of display in a case of performing the driving method of the liquid crystal display device, as illustrate in FIG. 5.

In this case, even if an attempt is made to display a black window on a central area of the screen with a uniform intermediate-gray-level green background, there may occur such a case that an area with a luminance, which is different from the luminance of the background, occurs at an upper/lower part of the display section, as shown in FIG. 6, and the luminance varies discontinuously at the boundary area.

This crosstalk becomes invisible if the second signal scan is stopped in the driving of the liquid crystal display device as shown in FIG. 5. Thus, the above-described crosstalk is considered to occur due to the second signal scan.

Figure 7:
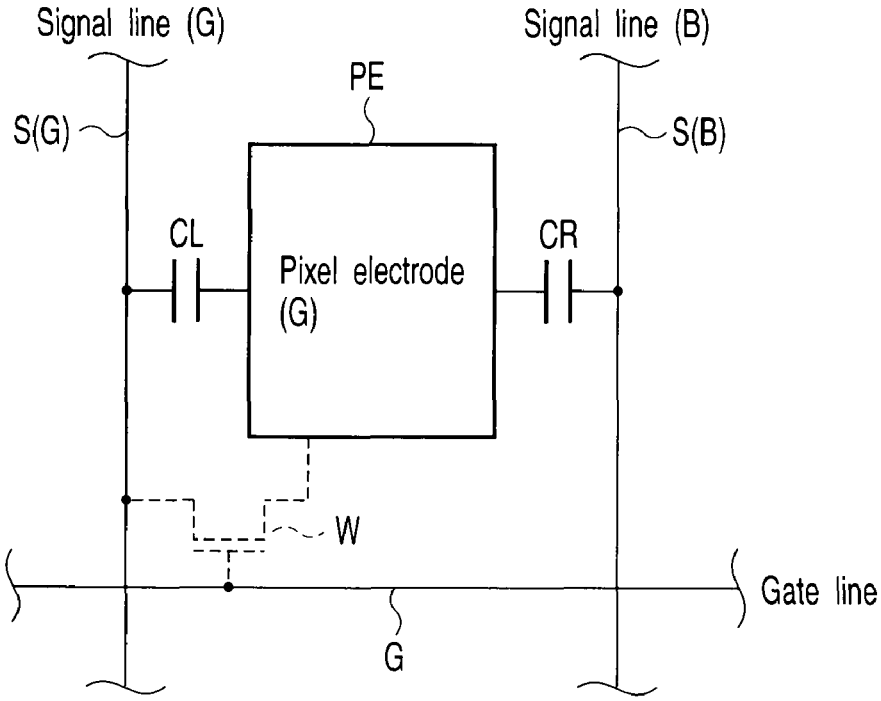
FIG. 7 is a view for explaining a cause which leads to the example of display shown in FIG. 6.

FIG. 7 shows an equivalent circuit of one liquid crystal pixel of the liquid crystal panel. FIG. 7 shows, by way of example, a case of a G pixel in an RGB array. A pixel switch W is connected between a pixel electrode PE(G) and a signal line S(G). The pixel switch W is ON/OFF controlled by the potential of the gate line G.

On the left side of the pixel electrode PE(G), the signal line S(G) for supplying a signal to the own pixel PX is disposed. On the right side of the pixel electrode PE(G), a signal line S(B) for supplying a signal to the right neighboring liquid crystal pixel PX (not shown) is disposed. Parasitic capacitances CL and CR occur between the pixel electrode PE(G) and these signal lines S. FIG. 7 omits depiction of the liquid crystal capacitance Clc which is constituted between the pixel electrode PE and the counter-electrode CE and the capacitance Cs which is constituted between the pixel electrode PE and the common capacitance line C.

Consideration is now given to a signal line potential variation at both ends of the pixel electrode PE(G) in the second signal scan period at positions of points P and Q in FIG. 6. In the pattern shown in FIG. 6, a blue (B) component is not displayed at all. Thus, with respect to the points P and Q, the potential of the signal line S(B), which is disposed on the right side of the pixel electrode PE(G), is always at a black voltage level over the entire second signal scan period.

By contrast, as regards the signal line S(G) which is disposed on the left side of the pixel electrode PE(G), since a window pattern of a green (G) component is displayed, the point P is always at the green potential level of the background. On the other hand, as regards the point Q, the potential changes from the background green level to the black voltage level, and further the potential changes from the black voltage level to the background green level.

This means that the coupling voltage, which is applied to the pixel electrode PE(G) from the signal line S(G) via the parasitic capacitance CL, differs between the point P and point Q. Specifically, this means that the pixel potential in the hold period differs between the point P and point Q, and it is thus considered that the luminance differs between both points, leading to occurrence of crosstalk.

Although a similar coupling voltage is applied in the first signal scan, since the backlight BL is turned off in this period, no crosstalk appears on the display screen.

By contrast, in the liquid crystal display device according to the present embodiment, the liquid crystal display device is driven as shown in FIG. 2 and FIG. 3. FIG. 2 shows the black insertion scan and the first signal scan in the period (first overlap period) in which the black insertion scan of the first period and the first signal scan of the second period overlap, and also shows the signal scans (first and second) in the period (second overlap period) from the completion of the black insertion scan to the completion of the first signal scan.

Specifically, in the driving method of the liquid crystal display device of the present embodiment, the operation in the first overlap period is the same as in the case of FIG. 5, but the operation in the second overlap period is different from the case shown in FIG. 5.

To be more specific, in the case shown in FIG. 5, the second signal scan begins after the completion of the first signal scan. In the driving method of the liquid crystal display device of the present embodiment, the second signal scan begins immediately after the completion of the first black insertion scan.

On the basis of the same concept as the concept that the black insertion scan and the first signal write scan are alternately executed in the first overlap period in units of 1 horizontal cycle, the second signal write scan and the first signal write scan are alternately executed in the second overlap period in units of 1 horizontal cycle.

The turn-on timing of the backlight BL is the same between the liquid crystal display device according to the present embodiment and the case shown in FIG. 5. Specifically, the turn-on of the backlight is started at the timing when the first signal write scan is substantially completed, and the turn-on of the backlight is finished at the timing when the black insertion is substantially started in the next frame.

According to the liquid crystal display device of the present embodiment, since the second signal scan progresses to some extent at the time point of the start of the turn-on of the backlight, the period in which the second signal scan is performed during the backlight turn-on period is shorter than in the case shown in FIG. 5. Thus, in the case of the liquid crystal display device of the present embodiment, the time period in which the pixel electrode PE(G) is affected by the coupling with the neighboring signal line S(B) is short, and the occurrence of vertical crosstalk is prevented.

Therefore, the present embodiment can provide a liquid crystal display device which prevents occurrence of crosstalk and has good display quality, and a driving method of the liquid crystal display device.

In particular, the time (corresponding to the period TB in FIG. 3) for executing black display in one frame is set to be long in the high-temperature environment in order to prevent reverse transition, the turn-on start timing of the backlight is delayed by the corresponding degree. As a result, the time period for execution of the second signal scan within the backlight turn-on period becomes still shorter, and the vertical crosstalk reduction effect becomes particularly conspicuous at high temperatures.

When the driving method of the liquid crystal display device of the present embodiment is compared with the driving method of FIG. 5, the second signal scan is started relatively earlier in the former method, and therefore a longer hold period following the second signal write can be secured within the turn-on period of the backlight BL.

Since the very object of the second signal write scan is to supplement the pixel charge that is not sufficient with the first signal write, the former method enables longer display with the enhanced pixel charge, and the adverse effect due to deficient signal write (e.g. the decrease in luminance) can greatly be reduced, compared to the case shown in FIG. 5.

In the driving method of the liquid crystal display device of the present embodiment, it is preferable to set the timing continuously from the first overlap period to the second overlap period, with the period TH being set as the horizontal cycle unit. In other words, it is preferable to set the timing over the time period from the first overlap period to the second overlap period, without causing a fractional period, which does not correspond to an integer number of times of the period TH, between both the overlap periods.

If the black insertion scan in the first overlap period corresponds to an odd-numbered period TH and the first signal write scan in the first overlap period corresponds to an even-numbered period TH, it is preferable to set the scan timing such that the second signal write scan in the following second overlap period corresponds to an odd-numbered period TH (following the black insertion scan in the first overlap period), and the first signal write scan in the second overlap period corresponds to an even-numbered period TH.

Thereby, the first signal write scan is always successively executed in even-numbered periods TH over the first and second overlap period, without disturbing the cycles. This prevents occurrence of a problem, such as horizontal streaks, due to a discontinuous luminance difference at a position corresponding to the boundary between the overlap periods.

Figure 8:
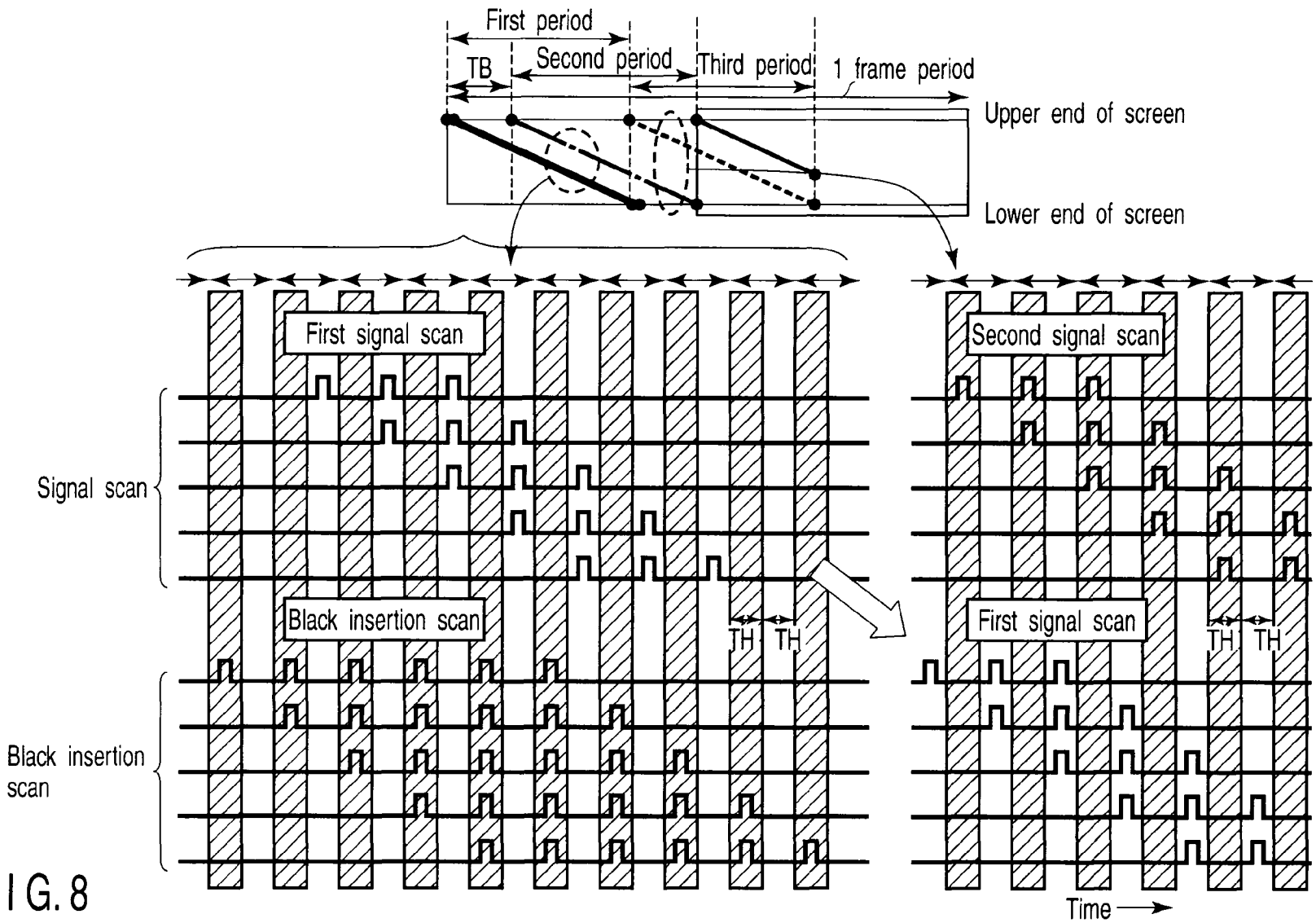
FIG. 8 is a view for explaining still another example of the driving method of the liquid crystal display device according to the embodiment.

After the end of the second overlap period, the second signal write scan is executed only in the odd-numbered period TH. In the even-numbered period TH that is left at this time, for example, as shown in FIG. 8, a gray level between black and white may be output as dummy signal write. Alternatively, for example, an average gray level of video signals, which are displayed over the entire screen, may be calculated and output. Thereby, the problem, such as horizontal streaks, due to the discontinuous luminance difference, can be reduced.

Figure 9:
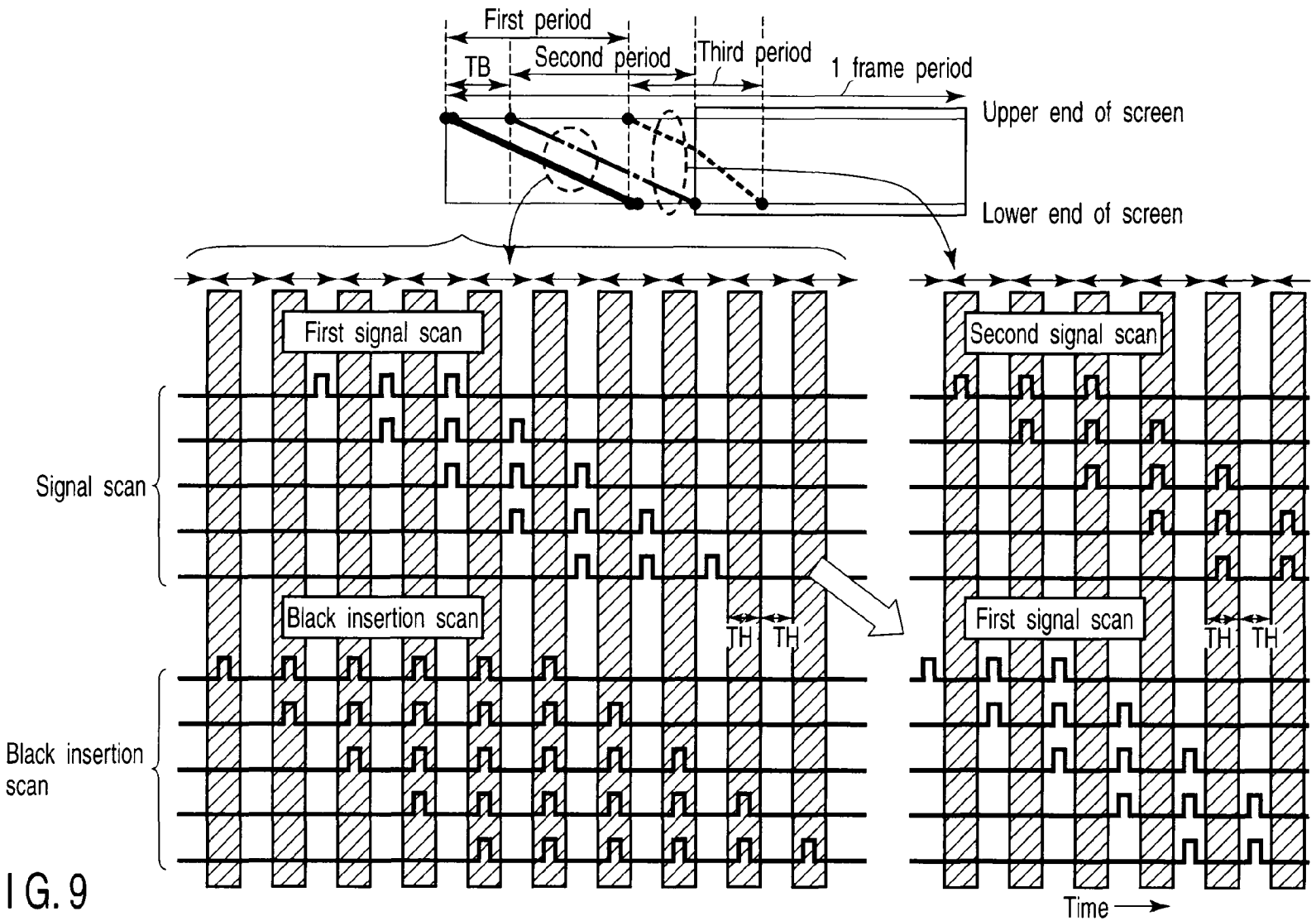
FIG. 9 is a view for explaining still another example of the driving method of the liquid crystal display device according to the embodiment.

Besides, as shown in FIG. 9, after the end of the second overlap period, it is thinkable to execute the second signal write scan at double speed by using both the even and odd periods TH. Thereby, the time of execution of the second signal scan in the backlight turn-on period is halved, and the crosstalk reduction effect becomes still more conspicuous.

The present invention is not limited directly to the above-described embodiment. In practice, the structural elements can be modified and embodied without departing from the spirit of the invention.

Various inventions can be made by properly combining the structural elements disclosed in the embodiment. For example, some structural elements may be omitted from all the structural elements disclosed in the embodiment. Furthermore, structural elements in different embodiments may properly be combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

a plurality of liquid crystal pixels which are arrayed substantially in a matrix;

a driver circuit which cyclically writes a non-video signal and a video signal to each of the plurality of liquid crystal pixels as pixel voltages; and a control circuit which controls an operation timing of the driver circuit, wherein the control circuit sets, in one frame period, a first period which is shorter than the one frame period, a second period which partly overlaps the first period and is shorter than the one frame period, and a third period which partly overlaps the second period and is shorter than the one frame period, and the control circuit is configured to execute control of the driver circuit such that write of the non-video signal in the plurality of liquid crystal pixels is executed in the first period, write of the video signal in the plurality of liquid crystal pixels is executed in the second period, write of the same video signal as the video signal, which is written in the second period, in the plurality of liquid crystal pixels is executed in the third period, the write of the non-video signal and the write of the video signal are alternately executed in units of one horizontal cycle or a plurality of horizontal cycles in a period in which the first period overlaps the second period, and the write of the video signal corresponding to the second period and the write of the video signal corresponding to the third period themselves overlap and are alternately executed in units of one horizontal cycle or a plurality of horizontal cycles in a period in which the second period overlaps the third period.

2. The liquid crystal display device according to claim 1, wherein the control circuit is configured to execute control of the driver circuit such that write of a dummy video signal and the write of the video signal corresponding to the third period are alternately executed in units of one horizontal cycle or a plurality of horizontal cycles in a period within the third period, which does not overlap the second period, and a predetermined dummy signal is output in a period in which the write of the dummy video signal is executed.

3. The liquid crystal display device according to claim 1, wherein the control circuit is configured to execute control of the driver circuit such that the write of the video signal corresponding to the third period is executed in a period within the third period, which does not overlap the second period, at double the speed of the write of the video signal corresponding to the third period in a period within the third period, which overlaps the second period.

4. The liquid crystal display device according to claim 1, wherein a liquid crystal is in an OCB mode.

5. A driving method of a liquid crystal display device, comprising:

setting, in one frame period, a first period which is shorter than the one frame period, a second period which partly overlaps the first period and is shorter than the one frame period, and a third period which partly overlaps the second period and is shorter than the one frame period;

executing write of a non-video signal in a plurality of liquid crystal pixels in the first period;

executing write of a video signal in the plurality of liquid crystal pixels in the second period;

executing write of the same video signal as the video signal, which is written in the second period, in the plurality of liquid crystal pixels in the third period, wherein executing write of the video signal in the second period and executing write of the same video signal in the third period themselves overlap;

alternately executing the write of the non-video signal and the write of the video signal in units of one horizontal cycle or a plurality of horizontal cycles in a period in which the first period overlaps the second period; and alternately executing the write of the video signal corresponding to the second period and the write of the video signal corresponding to the third period in units of one horizontal cycle or a plurality of horizontal cycles in a period in which the second period overlaps the third period.

* * * * *